US005152340A

United States Patent [19]

Clark et al.

[11] Patent Number: 5,152,340

[45] Date of Patent: Oct. 6, 1992

[54] HYDRAULIC SET PACKER AND TESTING APPARATUS

[75] Inventors: J. Allan Clark, South Lake; H. Kent Beck, Copper Canyon, both of Tex.

[73] Assignee: Halliburton Company, Duncan, Okla.

[21] Appl. No.: 648,662

[22] Filed: Jan. 30, 1991

[51] Int. Cl.[5] ..... E21B 33/124; E21B 33/126; E21B 49/08

[52] U.S. Cl. ..... 166/122; 166/106; 166/113; 166/187; 166/191

[58] Field of Search ..... 166/106, 191, 187, 120, 166/122, 127, 250, 147, 113

[56] References Cited

U.S. PATENT DOCUMENTS

| | | | |
|---|---|---|---|
| 2,715,444 | 8/1955 | Fewel | 166/187 |
| 2,738,013 | 3/1956 | Lynes | 166/187 X |
| 2,894,715 | 7/1959 | Bostock | 166/72 X |
| 2,946,388 | 7/1960 | Evans | 166/120 |
| 3,145,777 | 8/1964 | Cochran | 166/122 |
| 3,422,900 | 1/1969 | Hyde et al. | 166/131 |
| 3,525,393 | 8/1970 | Cobbs et al. | 166/187 |
| 4,049,055 | 9/1977 | Brown | 166/278 |
| 4,180,132 | 12/1979 | Young | 166/120 |
| 4,246,964 | 1/1981 | Brandell | 166/106 |
| 4,569,396 | 2/1986 | Brisco | 166/191 X |
| 4,580,632 | 4/1986 | Reardon | 166/250 |
| 4,646,829 | 3/1987 | Barrington et al. | 166/125 |
| 4,664,188 | 5/1987 | Zunkel et al. | 166/134 |
| 4,665,992 | 5/1987 | Franc | 166/122 X |
| 4,706,746 | 11/1987 | White et al. | 166/106 |
| 4,773,478 | 9/1988 | Streich | 166/120 |
| 4,791,992 | 12/1988 | Greenlee et al. | 166/187 X |
| 4,823,881 | 4/1989 | Streich | 166/382 |

FOREIGN PATENT DOCUMENTS

| | | | |
|---|---|---|---|
| 197708 | 9/1977 | U.S.S.R. | 166/187 |

*Primary Examiner*—Hoang C. Dang
*Attorney, Agent, or Firm*—C. Dean Domingue; Neal R. Kennedy

[57] ABSTRACT

A hydraulic set packer for use in a well bore as part of a testing apparatus. The packer comprises a housing defining a generally annular piston chamber therein. A cylindrical portion of an annular piston is slidably disposed in the piston chamber. The piston also has a shoe portion adjacent to a packer element on the housing. An inner mandrel is disposed in the housing, and the housing and inner mandrel define a passageway therein such that fluid pressure may be applied to the piston for moving it against the packer element such that the packer is set in sealing engagement with the well bore. The passageway extends the full length of the housing so that it may be in communication with another hydraulic packer positioned therebelow. One or more packers may be used in a downhole tool on a testing string for use in testing a well formation. The packer may also be used on a tubing string for testing a blowout preventer.

6 Claims, 4 Drawing Sheets

HYDRAULIC SET PACKER AND TESTING APPARATUS

BACKGROUND OF THE INVENTION

1. Field of the Invention

This invention relates to downhole testing tools, and more particularly, to a testing apparatus using a hydraulic set packer.

2. Description of the Prior Art

A known method of testing a well formation is to isolate the formation between a pair of inflatable packers with a flow port therebetween adjacent to the formation. The packers are inflated by means of a pump in the testing string which pumps well annulus fluid or mud into the packers to place them in sealing engagement with the well bore. A variety of such pumps is available.

Some downhole pumps are actuated by the vertical reciprocation of the tubing string connected to the pump. Other pumps are operated by rotation of the tubing string relative to the pump structure connected thereto, and one type of rotationally operated pump uses a plurality of vertically reciprocating pistons which are driven by a cam structure. Inlet and outlet valves are positioned adjacent to each of the pistons. Later pumps have a simpler, sleeve-type pump piston.

As mentioned, these pumps may be used to inflate inflatable packers, such as the Halliburton Services Hydroflate® packer. Such packers are frequently used in applications where there is not enough weight on the tool string sufficient to set other types of packers. Another advantage of inflatable packers is that they are flexible and are well adapted for use in well bores which are considerably larger, relatively, than the tool string. However, inflatable packers generally will not hold as much pressure as a squeeze packer.

In addition to the problem of not having enough weight to set a typical squeeze packer, packers of this type, such as the RTTS packer and Champ® III packer also manufactured by Halliburton Services, require the use of mechanical slips to grippingly engage the well bore before the packer element may be set.

The hydraulic set packer and testing apparatus of the present invention solves the problems of both inflatable packers and typical squeeze packers. The packer of the present invention is set hydraulically by pumping fluid thereto. This pumping may be done with the same type of pump as for inflatable packers or by pumping from the surface. An advantage is the hydraulic set packer will hold more pressure than a comparable inflatable packer. Also, the packer of the present invention is more cost effective than a typical squeeze packer and does not require any mechanical slips against the well bore.

In addition to drill stem testing, inflatable packers are used in testing blowout preventers. The hydraulic set packer of the present invention may be used to replace such inflatable packers in blowout preventer testing, and again, the hydraulic set packer has the advantage of holding more pressure than the inflatable packer, thereby generally achieving better test results.

Hydraulic packers are known in the art, but have not been used in a well testing string of the type of the present invention. Further, the preferred embodiment of the packer of the present invention has a simple construction utilizing a piston slidably disposed in a piston chamber and wherein a portion of the piston directly engages the packer element during a setting operation.

SUMMARY OF THE INVENTION

The hydraulic set packer and testing apparatus of the present invention are designed for use in downhole well formation testing and for other uses such as blowout preventer testing. The testing apparatus is in the form of a downhole tool for use on a testing string in a well bore and comprises a tester valve and a hydraulic packer which is positionable in the well bore. In well testing, the packer is positionable above a formation to be tested. In many testing applications, the hydraulic packer is one of a pair of such hydraulic packers wherein the packers are positionable on opposite sides of the formation. The hydraulic packer is actuated to a set position by fluid pressure from a pressure source. The pump may be used for pumping fluid to the hydraulic packer and thereby acting as the pressure source. In an alternate embodiment, the tool may further comprise conduit means for providing fluid pressure between the piston and the pressure source. In this embodiment, the pressure source may be provided at the surface of the well. The packer is unset by relieving the fluid pressure therein.

The packer apparatus itself comprises housing means for connecting to a tool or tubing string and defining a piston chamber therein, packer means on the housing means for sealingly engaging the well bore when in a set position, and a piston having a portion slidably disposed in the piston chamber and adjacent to the packer means. The piston is movable in response to a pressure in the piston chamber, namely the fluid pressure mentioned above, such that the piston engages the packer means, thereby moving the packer means to the set position.

The packer apparatus may further comprise passageway means in the housing means for providing communication between an upper portion of the housing mean and the piston chamber. Preferably, the passageway means is also adapted for providing communication between the upper portion of the housing means and the lower portion of the housing means so that fluid pressure may also be provided to another such packer positioned therebelow. The passageway means may be characterized by a longitudinally extending passageway which essentially extends the full length of the housing means.

In one preferred embodiment, the piston chamber is an annular chamber defined in the housing means, and the portion of the piston disposed therein has a generally cylindrical configuration. The piston also comprises an outwardly enlarged shoe portion at the end of the cylindrical portion, the shoe portion being adjacent to the packer means.

The housing means may comprise a packer mandrel portion on which the packer means is disposed and a cylinder spaced outwardly from the packer mandrel portion such that the piston chamber is defined between the packer mandrel portion and the cylinder. The shoe portion of the piston has a shoulder thereon such that movement of the piston in one direction is limited by contact on the shoulder with an end of the cylinder. This one direction is away from the packer means.

Outer sealing means may be provided for sealing between the piston and an outer portion of the housing means, such as the cylinder, and an inner sealing means may be provided for sealing between the piston and an inner portion of the housing means, such as the packer mandrel portion.

When fluid pressure is applied to the piston chamber, the piston is moved against the packer means. The packer means may be characterized by an elastomeric packer element disposed on the packer mandrel portion of the housing means, and the packer element is squeezed by the piston such that the packer element is deflected radially outwardly into sealing engagement with the well bore. When pressure is relieved in the piston chamber, the packer element will substantially return to its original shape, thereby moving the piston back to its original position.

An important object of the present invention is to provide a hydraulic set packer having a pressure actuated annular piston for squeezing a packer element on the packer.

Another object of the invention is to provide a well formation testing apparatus having a hydraulic set packer.

An additional object of the invention is to provide a hydraulic set packer used to replace inflatable packers in a testing apparatus, such that higher test pressures may be achieved than with the corresponding inflatable packers.

Additional objects and advantages of the invention will become apparent as the following detailed description of the preferred embodiment is read in conjunction with the drawings which illustrate such preferred embodiment.

DESCRIPTION OF THE PREFERRED EMBODIMENT

Figure 1:
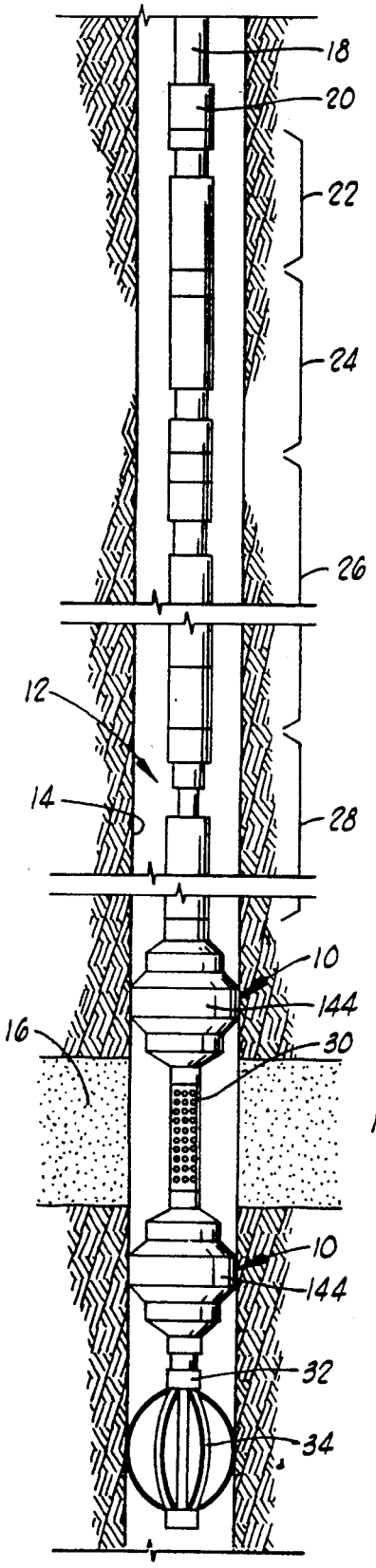
FIG. 1 shows the downhole hydraulic set packer and testing apparatus, including a pump and pressure limiter, of the present invention in position in a well bore for testing a well formation.

Referring now to the drawings, and more particularly to FIG. 1, the hydraulic set packer of the present invention is shown and generally designated by the numeral 10. Actually, in the illustrated embodiment, two packers are shown and will be referred herein as upper and lower packers 10.

Upper and lower packers 10 form a part of a testing apparatus 12. Testing apparatus 12, which may also be referred to as testing string or tool 12, is shown in position in a well bore 14 for use in testing a well formation 16.

Testing apparatus 12 is attached to the lower end of a tool string 18 and includes a reversing sub 20, a tester valve 22 such as the Halliburton Hydrospring® tester, an extension joint 24, a pump 26, and a safety joint 28, such as the Halliburton Hydroflate® safety joint, all of which are positioned above upper packer 10.

Upper packer 10 is attached to the lower end of safety joint 28 and is positioned above well formation 16. Lower packer 10 is positioned below well formation 16. A porting sub 30 interconnects upper and lower packers 10. An equalizing tube and spacers (not shown) may also be used between upper and lower packers 10 depending upon the longitudinal separation required therebetween.

A gauge carrier 32 is attached to the lower end of lower packer 10 and includes a plurality of drag springs 34 which are adapted to engage well bore 14 and prevent rotation of a portion of testing string 12 during actuation of upper and lower packers 10, as hereinafter described.

Figure 2:
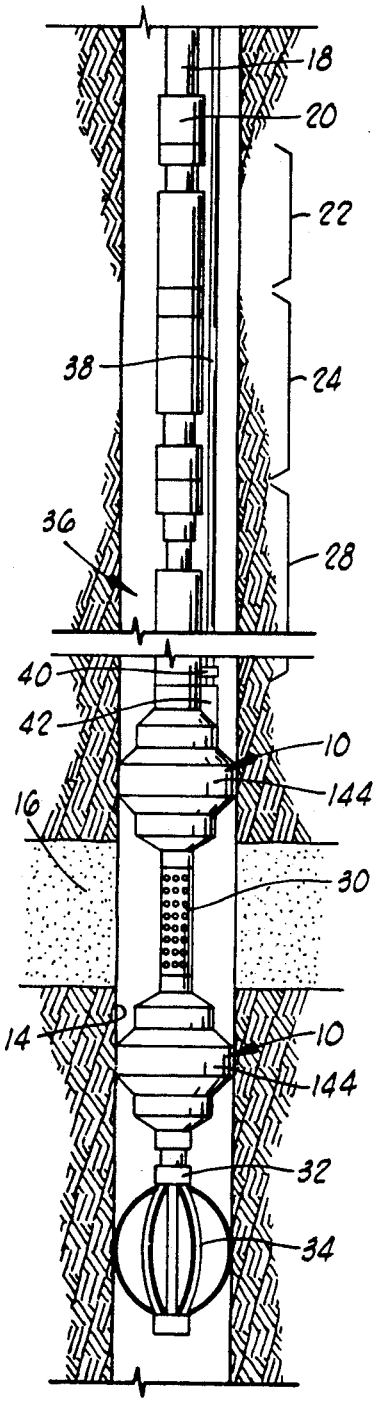
FIG. 2 illustrates an alternate embodiment of the testing apparatus using the hydraulic set packer which is set by pressure applied from the surface through hose or tubing rather than by a pump in the tool.

Referring now to FIG. 2, upper and lower packers 10 are shown as forming a part of an alternate testing apparatus 36, also referred to as a testing string or tool 36. Testing apparatus 36 is also attached to a tool string 18 and includes reversing sub 20, testing valve 22, extension joint 24, safety joint 28, porting sub 30, gauge carrier 32 and drag springs 34. It will be seen by those skilled in the art that testing apparatus 36 is similar to testing apparatus 12, but testing apparatus 36 does not include a pump.

Instead of a pump, packers 10 are actuated by surface applied pressure as a result of fluid pumped through a conduit means, such as a hose or tubing 38. Hose 38 may be connected to upper packer 10 or a portion of the tool string above the upper packer by any means known in the art, such as a tubing connector 40 engaging an adapter 42. Alternatively, connector 40 could be directly engaged with packer 10 or another portion of the tool string. Also, adapter 42 could be an integral part of upper packer 10.

Figure 3:
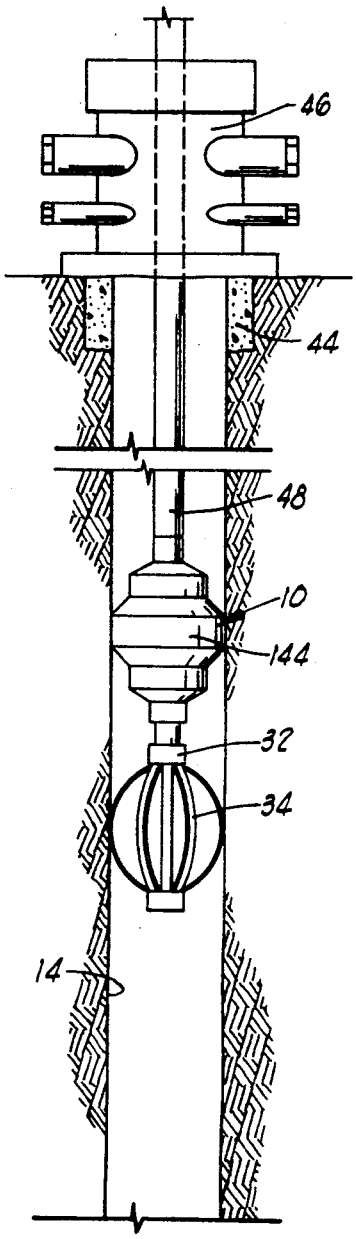
FIG. 3 illustrates the hydraulic set packer of the present invention on the end of a tubing string in position in a well bore for testing a blowout preventer.

Referring now to FIG. 3, another use for packer 10 is shown. In this application, packer 10 is disposed in a well bore 14 below wellhead 44. A blowout preventer 46 is positioned on wellhead 44. Packer 10 is attached to a tubing string 48 which extends upwardly through blowout preventer 46. A gauge carrier 32 and drag springs 34 may be positioned below packer 10 to centralize the packer in well bore 14.

Figure 4A:
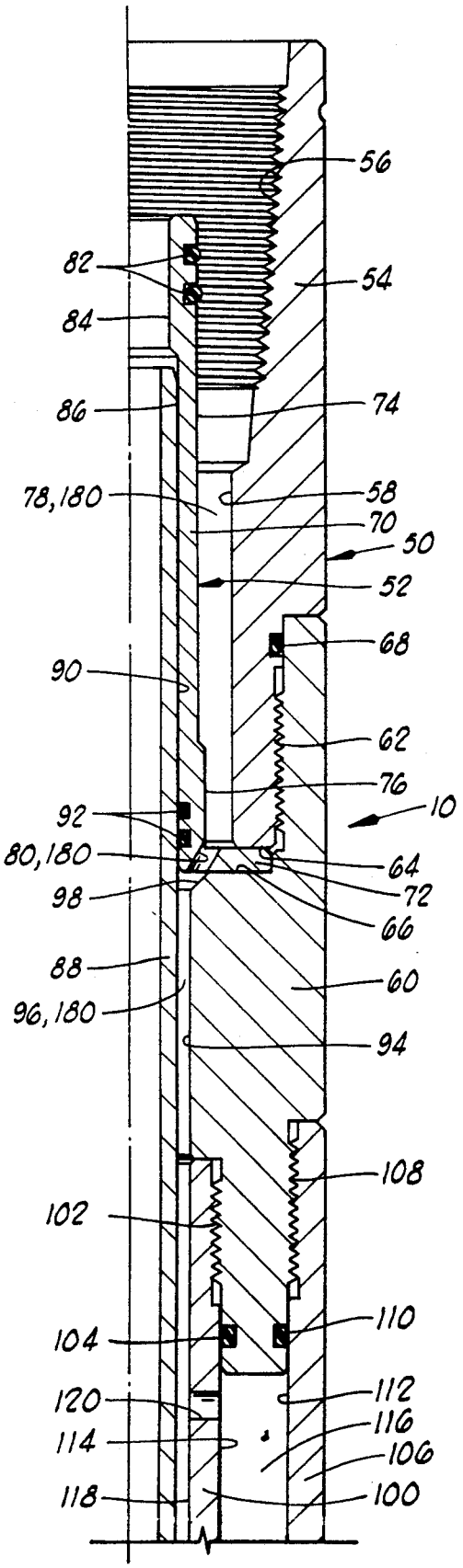
FIGS. 4A-4C show a partial longitudinal cross section of the hydraulic packer of the present invention prior to actuation.
Figure 4B:
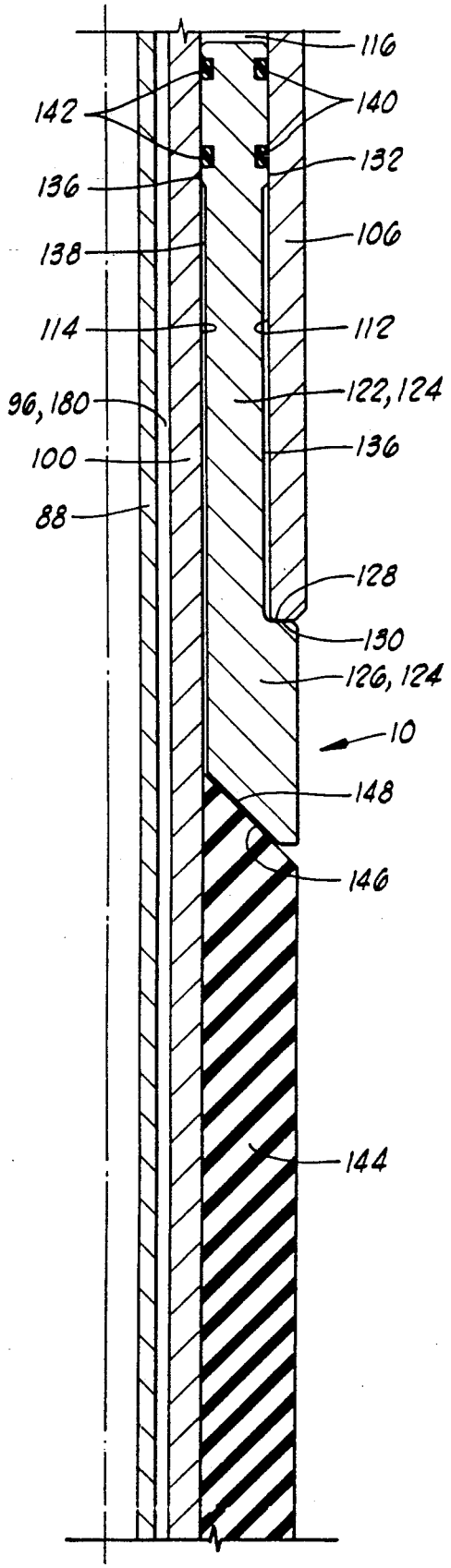
Figure 4C:
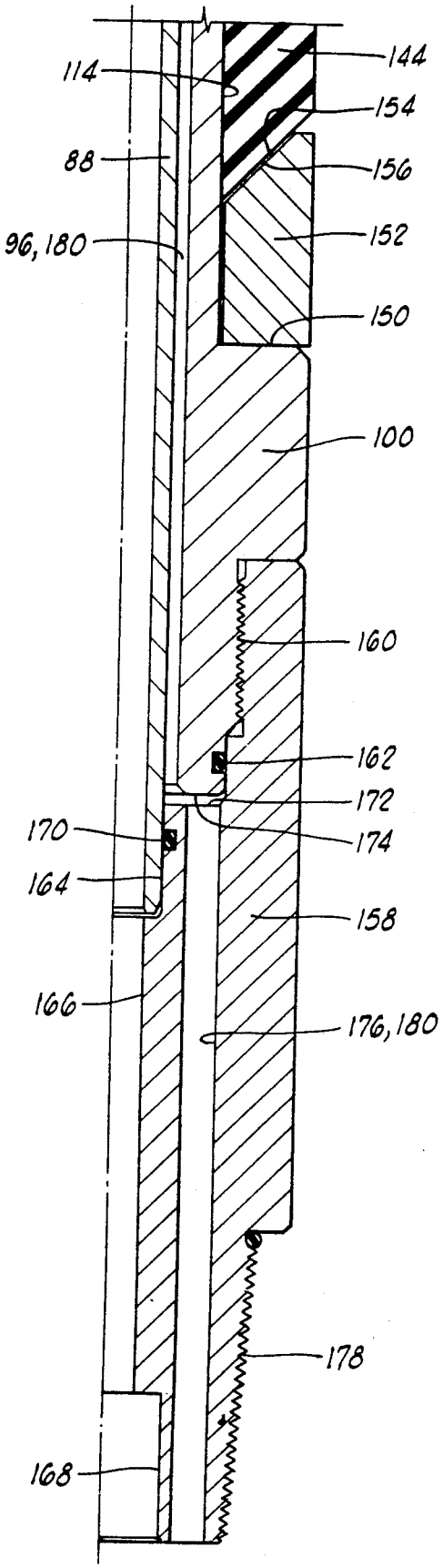

Referring now to FIGS. 4A-4C, the details of hydraulic set packer 10 are shown. Packer 10 generally includes outer housing means 50 with inner mandrel means 52 disposed therein.

Housing means 50 includes a top adapter 54 with an internally threaded upper end 56 adapted for attachment to an upper portion of testing apparatus 12 above packer 10. Top adapter 54 also defines a bore 58 therethrough.

A lower portion of top adapter 54 is connected to a piston adapter 60 at threaded connection 62 such that a lower end 64 of top adapter 54 is spaced above an upwardly facing annular shoulder 66 in piston adapter 60 thereby defining a gap therebetween. A sealing means, such as O-ring 68, provides sealing engagement between top adapter 54 and piston adapter 60.

A mandrel guide 70 is disposed in top adapter 54 and has an outwardly extending lower flange 72 which extends into the gap defined between end 64 and shoulder 66. Mandrel guide 70 has a first outside diameter 74 and a second outside diameter 76 which are spaced inwardly from bore 58 in top adapter 54 such that an annular passageway 78 is defined therebetween. Extending at least partially through flange 72 of mandrel guide 70 is a angularly disposed hole 80 which is in communication with passageway 78.

A sealing means, such as a plurality of O-rings 82, is provided so that the upper end of mandrel guide 70 may be sealingly engaged with a tubular member (not shown) extending from a portion of testing apparatus 12 above packer 10. This engagement and sealing is of a kind known in the art.

Mandrel guide 70 has a first bore 84 and a somewhat larger second bore 86 therein.

In the illustrated embodiment, mandrel means 52 is characterized by an elongated inner mandrel 88. The upper end of inner mandrel 88 is disposed in mandrel guide 70, and the inner mandrel has a outside diameter 90 adapted to fit closely within second bore 86 of the mandrel guide. A sealing means, such as a plurality of O-rings 92, provides sealing engagement between mandrel guide 70 and inner mandrel 88.

Piston adapter 60 defines a bore 94 therethrough which is spaced outwardly from outside diameter 90 of inner mandrel 88 such that there is an annular passageway 96 defined therebetween. A chamfer 98 extends between bore 94 in piston adapter 60 and shoulder 66 of the piston adapter. Chamfer 98 is adjacent to hole 80 in mandrel guide 70, and it will be seen by those skilled in the art that passageway 98 is thus in communication with hole 80.

Piston adapter 60 is attached to a packer mandrel 100 at an inner threaded connection 102. A sealing means, such as O-ring 104, provides sealing engagement between piston adapter 60 and packer mandrel 100.

At the lower end of piston adapter 60 is also attached to a cylinder 106 at outer threaded connection 108. Another sealing means, such as O-ring 110, provides sealing engagement between piston adapter 60 and cylinder 106.

Cylinder 106 has an inside diameter 112 which is spaced radially outwardly from outside diameter 114 of packer mandrel 100 such that an annular piston chamber 116 is defined therebetween.

Packer mandrel 100 has a bore 118 therethrough which is approximately the same size as bore 94 in piston adapter 60 such that annular passageway 96 is continued downwardly. Packer mandrel 100 also defines a transverse port 120 therethrough, and it will be seen that port 120 provides communication between passageway 96 and chamber 116.

Referring now to FIG. 4B, a generally cylindrical upper portion 122 of a hydraulic piston 124 is disposed in piston chamber 116 between cylinder 106 and packer mandrel 100. Piston 124 also includes an outwardly enlarged lower portion 126 below cylinder 106. As will be further discussed herein, enlarged lower portion 126 of piston 124 also functions as an upper packing shoe. Upward movement of piston 124 is limited by engagement of a shoulder 128 on the piston with lower end 130 of cylinder 106.

Cylindrical portion 122 of piston 124 has a first outside diameter 132 which is in close siding relationship with bore 112 in cylinder 106. Cylindrical portion 122 also has a slightly smaller second outside diameter 13 which provides a relief. Piston 124 has a first bore 136 therein which is adapted for close, sliding relationship with outside diameter 114 of packer mandrel 100. Piston 124 also has a slightly larger second bore 138 which acts as a relief. Sealing between piston 124 and cylinder 106 is provided by an outer sealing means, such as a plurality of outer piston rings 140, and similarly, sealing is provided between piston 124 and packer mandrel 100 by an inner sealing means, such as a plurality of inner piston rings 142.

An elastomeric packer element 144 is disposed on and around packer mandrel 100 below hydraulic piston 124. A tapered bore 146 in lower portion 126 of piston 124 is adjacent to a tapered surface 148 on packer element 144.

Referring now to FIG. 4C, packer mandrel 100 has an upwardly facing annular shoulder 150 thereon. A lower packer shoe 152 is positioned on packer mandrel 100 adjacent to shoulder 150 and has a tapered bore 154 therein. Tapered bore 154 is adjacent to a tapered surface 156 on the lower end of packer element 144.

The lower end of packer mandrel 100 is attached to a lower adapter 158 at threaded connection 160. A sealing means, such as O-ring 162, provides sealing engagement between packer mandrel 100 and lower adapter 158.

Lower adapter 158 defines a first bore 164, a second bore 166, and a third bore 168 therein. The lower end of inner mandrel 88 is disposed in first bore 164. A sealing means, such as O-ring 170, provides sealing engagement between lower adapter 158 and inner mandrel 88. Third bore 168 is adapted to receive a portion of testing string 12 below packer 10 in a manner known in the art.

Lower adapter 158 has an upwardly facing annular shoulder 172 therein which is spaced below lower end 174 of packer mandrel 100, such that an annular gap is defined therebetween. A longitudinal hole extends downwardly from shoulder 172 in lower adapter 158, and it will be seen that hole 176 is in communication with annular passageway 96.

Lower adapter 158 has an externally threaded surface 178 which is adapted for connection to a lower portion of testing apparatus 12 below packer 10.

It will be seen that a passageway means 180 is defined through the full length of housing means 50 of packer 10. In the embodiment shown, passageway means 180 comprises passageway 78, hole 80, passageway 96, the gap between shoulder 172 and end 174, and hole 176.

OPERATION OF THE INVENTION

When the present invention is used for testing a well formation 16, testing apparatus 12 is lowered into well bore 14 until upper and lower packers 10 are properly positioned on opposite sides of formation 16. See FIGS. 1 and 2.

Drag springs 34 at the lower end of testing apparatus 12 help center the apparatus and prevent rotation of the lower portion of it. If pump 26 is of the type that is operated by rotation of tool string 18, this lower portion of testing apparatus 12 includes a lower portion of pump 26.

Once positioned, upper and lower packers 10 are inflated by any of a variety of methods known in the art. In the embodiment of FIG. 1, pump 26 may be of a type actuated by rotation of tool string 18, or alternatively, actuated by reciprocation of tool string 18. Such pumps move well annulus fluid downwardly through the testing apparatus into passageway means 180 in upper packer 10.

Figure 5A:
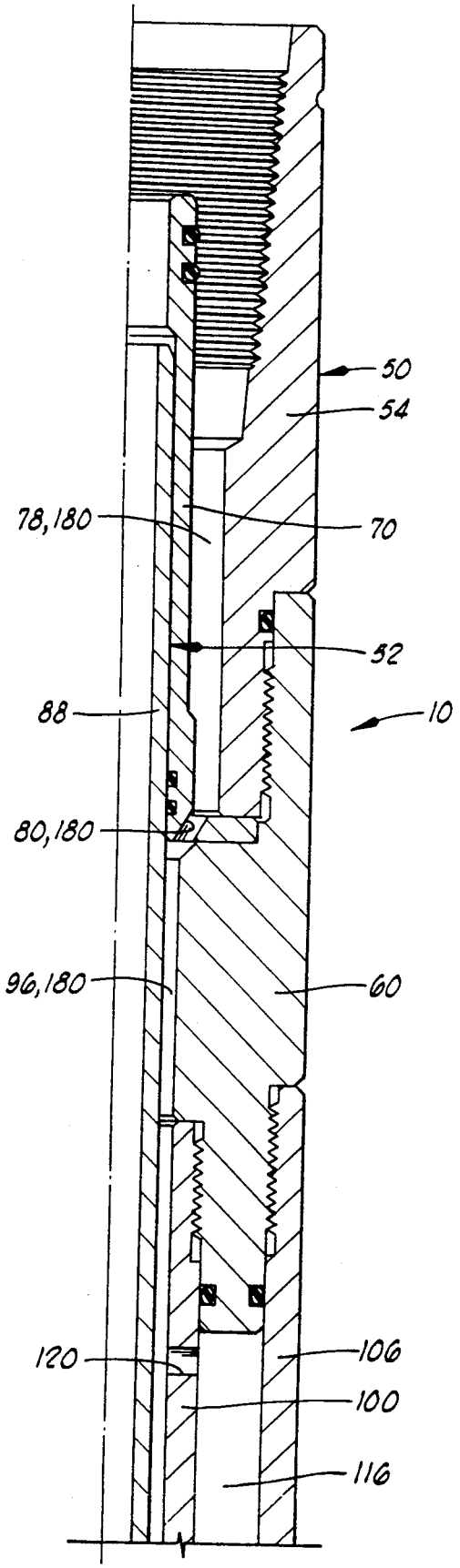
FIGS. 5A-5C illustrate the hydraulic set packer actuated to a set position.
Figure 5B:
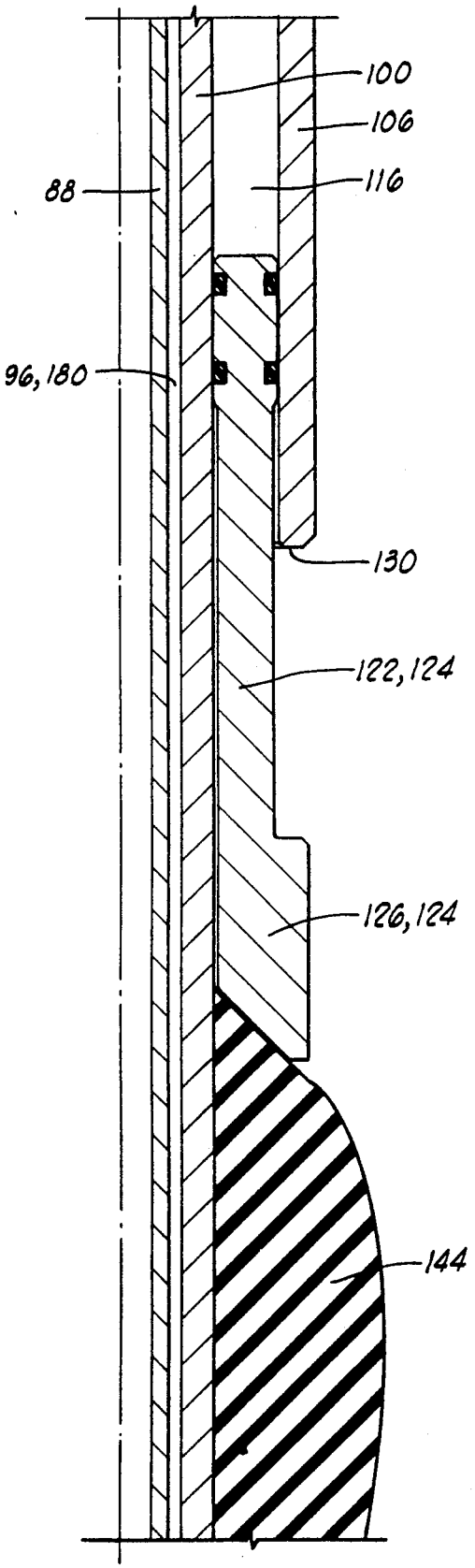
Figure 5C:
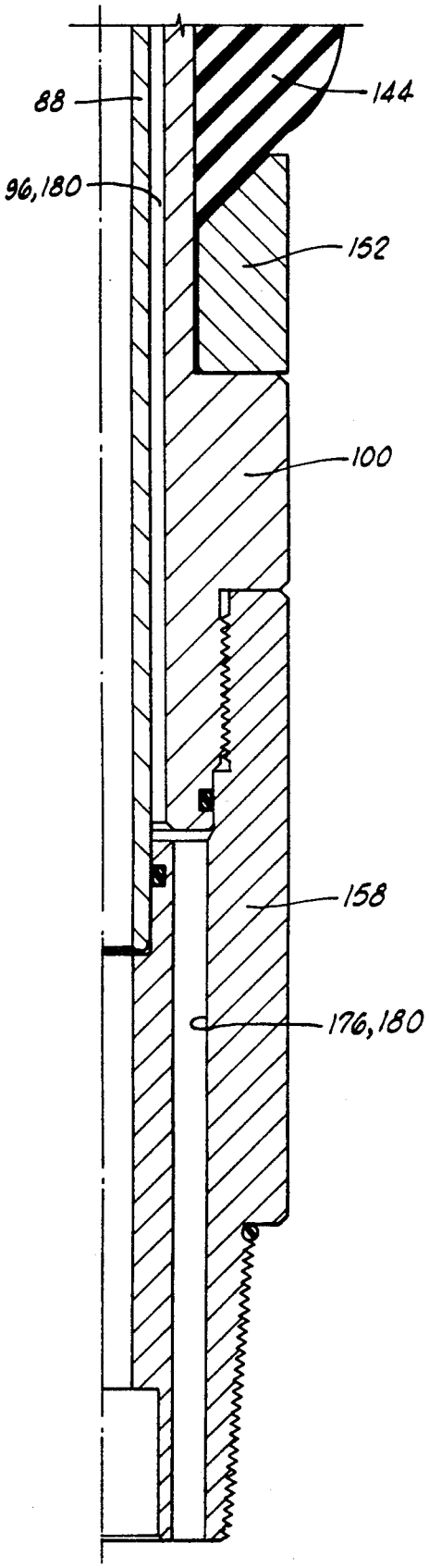

Fluid thus pumped to passageway means 180 will thus be seen to enter chamber 116 through port 120. As the pressure increases, it acts against the upper end of piston 124, forcing it downwardly against packer element 144. As piston 124 moves downwardly, packer element 144 is squeezed outwardly, as seen in FIGS. 5A-5C, such that the packer element is sealingly engaged with well bore 14.

In the embodiment shown in FIG. 2, fluid pressure is applied to upper packer 10 by pumping from the surface through hose 38, rather than by manipulation of tool string 18 to actuate a pump.

Regardless of how pressure is applied to upper packer 10, actuation of piston 124 therein and outward deflection of corresponding packer element 144 is substantially the same.

As pressure is applied to passageway means 180 in upper packer 10, it is also applied to the corresponding passageway means 180 in lower packer 10. The passageway means in upper and lower packers 10 are interconnected through a passageway known in the art which is defined in porting sub 30. Thus, as upper packer 10 is being actuated to place its packer element 144 in sealing engagement with well bore 14, similar actuation occurs with lower packer 10.

During the operation of pump 26, if any, it is generally desirable to limit the pressure output by the pump so that the displacement of piston 124 downwardly is not too great which could damage packer element 144 or cause the piston to come free of lower end 130 of cylinder 106. Such pressure limiters for a pump actuated by rotation are known.

Once testing of fluids in well formation 16 is completed, the pressure is relieved above upper packer 10 such that pressure is relieved in piston chambers 116 and thereby relieved on pistons 124. Resilient packer elements 144 will return substantially to their original positions, thereby moving pistons 124 back upwardly to their original positions. The tool may then be removed from well bore 14 or moved to a different location therein for testing another well formation.

When used to test blowout preventer 46, a single packer 10 is generally sufficient, as seen in FIG. 3. Actuation of packer 10 may be accomplished by applying pressure thereto using any means known in the art. Once packer 10 is set into sealing engagement with well bore 14, pressure may be applied in the well annulus to test blowout preventer 46 in a conventional manner.

It will be seen, therefore, that the hydraulic set packer and testing apparatus of the present invention are well adapted to carry out the ends and advantages mentioned as well as those inherent therein. While presently preferred embodiments of the invention are shown for the purposes of this disclosure, numerous changes in the arrangement and construction of parts may be made by those skilled in the art. All such changes are encompassed within the scope and spirit of the appended claims.

What is claimed is:

1. A packer apparatus for use in a well bore, said apparatus comprising:

a housing comprising:

an upper portion connectable to a tool string;

a cylindrical portion extending downwardly from said upper portion and having a shoulder defined on a lower end thereof;

a packer mandrel portion extending downwardly from said upper portion, said cylindrical portion and said packer mandrel portion defining an annular piston chamber therebetween, and said packer mandrel portion defining a port therethrough providing communication between said piston chamber and a pressure source in the tool string; and a lower portion attached to said packer mandrel portion and defining a longitudinal bore therethrough;

an inner mandrel disposed in said housing such that said housing and said inner mandrel define a longitudinally extending passageway therebetween said passageway being in communication with said piston chamber and said longitudinal bore;

a piston comprising:

a generally cylindrical portion slidably disposed in said piston chamber; and a shoe portion at an end of said cylindrical portion; and an elastomeric packer element disposed on said packer mandrel portion of said housing and adjacent to said shoe portion of said piston.

2. The apparatus of claim 1 further comprising:

outer sealing means for sealing between said piston and said cylindrical portion; and inner sealing means for sealing between said piston and said packer mandrel portion of said housing.

3. The apparatus of claim 1 wherein said shoe portion of said piston has a piston shoulder thereon such that movement of said piston in one direction is limited by contact of said piston shoulder with said shoulder on said end of said cylindrical portion.

4. The apparatus of claim 1 further comprising a packer shoe disposed on said packer mandrel portion of said housing adjacent to said packer element on an opposite side thereof from said piston.

5. A packer apparatus for use in a well bore, said packer apparatus comprising:

housing means having means for connecting to a tool string, said housing means comprising:

a top adapter;

a piston adapter attached to said top adapter;

a cylindrical member having a first end attached to said piston adapter and a second end having a shoulder defined thereon;

a packer mandrel having a first end attached to said piston adapter and a second end, said cylindrical member and said packer mandrel defining an annular chamber therebetween, and said packer mandrel defining a port therein for transmitting pressure from a pressure source in the tool string; and a lower adapter attached to said packer mandrel, said lower adapter defining a longitudinal bore therethrough;

passageway means disposed within said housing means and in communication with said longitudinal bore in said lower adapter, for communicating pressure from said pressure source, wherein said passageway means comprises:

a mandrel guide attached to said housing means, and defining a port therein for communicating pressure from said pressure source; and an inner mandrel disposed within said housing means, said housing means and said inner mandrel being positioned so that an annular passageway is defined therebetween, said annular passageway allowing communication of pressure from said pressure source;

packer element means, disposed on said housing means, for sealingly engaging said well bore when in a set position, said packer element means comprising a first end having a first chamfered surface and a second end having a second chamfered surface;

an annular piston slidably disposed within said annular chamber, said annular piston comprising:

a first portion with sealing means disposed thereon for sealing between said annular piston and said annular chamber;

a second portion having a piston shoulder, said piston shoulder cooperating with said shoulder on said cylindrical member of said housing means for limiting upward travel of said annular piston in said annular chamber; and a third portion containing a chamfered surface adjacent to said packer element means, and cooperating with said first chamfered surface of said packer element means, so that, as pressure is applied to said annular chamber, the pressure is transmitted to said annular piston whereby said annular piston is moved longitudinally downwardly thereby setting said packer element means; and a packer shoe, disposed on said housing means, said packer shoe having a chamfered surface which cooperates with said second chamfered surface of said packer element means for setting said packer element means.

6. The apparatus of claim 5, wherein:

the packer apparatus is a portion of the tool string; and said tool string contains a tester valve for testing a well formation.

* * * * *